US008220292B2

(12) United States Patent
Czyzewski et al.

(10) Patent No.: US 8,220,292 B2
(45) Date of Patent: Jul. 17, 2012

(54) DETERMINATION OF THE WATER STORAGE CAPACITY OF TEXTILES IN A WASHING MACHINE, AND CORRESPONDING WASHING MACHINE

(75) Inventors: Gundula Czyzewski, Berlin (DE); Ingo Schulze, Panketal (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 790 days.

(21) Appl. No.: 12/308,735

(22) PCT Filed: Jun. 12, 2007

(86) PCT No.: PCT/EP2007/055737

§ 371 (c)(1),
(2), (4) Date: Dec. 19, 2008

(87) PCT Pub. No.: WO2008/000614

PCT Pub. Date: Jan. 3, 2008

(65) Prior Publication Data

US 2009/0307850 A1 Dec. 17, 2009

(30) Foreign Application Priority Data

Jun. 29, 2006 (DE) ..... 10 2006 029 950

(51) Int. Cl.

| | |
|---|---|
| ***D06F 33/00*** | (2006.01) |
| ***D06F 39/04*** | (2006.01) |
| ***D06F 39/08*** | (2006.01) |
| ***D06F 35/00*** | (2006.01) |

(52) U.S. Cl. ..... 68/12.05; 68/12.21; 8/158

(58) Field of Classification Search ..... 68/12.05, 68/12.21; 8/158
See application file for complete search history.

(56) References Cited

U.S. PATENT DOCUMENTS

| | | | | |
|---|---|---|---|---|
| 5,259,217 | A * | 11/1993 | Civanelli et al. | 68/12.04 |
| 6,023,950 | A * | 2/2000 | Battistella | 68/12.04 |
| 6,842,929 | B2 * | 1/2005 | Kim et al. | 8/159 |
| 2003/0024056 | A1 | 2/2003 | Kim et al. | |
| 2005/0204481 | A1 | 9/2005 | Czyzewski et al. | |

FOREIGN PATENT DOCUMENTS

| | | |
|---|---|---|
| DE | 41 38 636 | 5/1993 |
| DE | 195 38 291 | 4/1997 |
| EP | 0 616 068 | 9/1994 |
| EP | 0 787 848 | 8/1997 |

OTHER PUBLICATIONS

International Search Report PCT/EP2007/055737.

* cited by examiner

*Primary Examiner* — Michael Barr
*Assistant Examiner* — Charles W Kling
(74) *Attorney, Agent, or Firm* — James E. Howard; Andre Pallapies

(57) ABSTRACT

A method for determining the water storage capacity of textiles, wherein the rinsing phase has at least one rinsing sequence which follows a drying sequence. The method is characterized in that a first water absorption is measured during the wetting phase and a second water absorption is measured during at least one of the rinsing sequences, in that the two water absorption measurements are compared with one another and the water storage capacity of the textiles is defined using the comparison.

17 Claims, 3 Drawing Sheets

DETERMINATION OF THE WATER STORAGE CAPACITY OF TEXTILES IN A WASHING MACHINE, AND CORRESPONDING WASHING MACHINE

BACKGROUND OF THE INVENTION

The invention relates to a method for determination of the water storage capacity of textiles in a washing machine which is equipped with devices for driving a washing drum supported rotatably in a tub as well as for controlling a wetting phase and a rinsing phase of a washing process, with the rinsing phase featuring at least one rinsing sequence which follows a drying sequence.

The invention also relates to a washing machine comprising a control device which is configured for determining the water storage capacity of textiles as well as for controlling a wetting phase of a washing process, with the rinsing phase featuring at least one rinsing sequence following the drying sequence, as well as comprising a tub, a washing drum supported rotatably in the tub for accepting the textiles as well as devices for driving the washing drum.

SUMMARY OF THE INVENTION

Textiles differ greatly in their water storage capacity, for example depending on the type of textile fiber, the textile surface pattern obtained therefrom, the finishing and last but not least the textile treatment. Thus untreated natural plant or animal fibers can accept up to a multiple of their own weight of water and store it in fiber structures—e.g. in fiber gaps and capillaries. The water taken up leads inter alia to a swelling of the fibers. Textiles can also be made using the surface treatment to be hydrophobic (repelling water, e.g. through impregnation) or hydrophilic (attracting water).

Previously the different phases of a cleaning process (typically in the order: wetting phase—wash phase—rinse phase—spin phase) were based on the preset program and the parameters measured directly in the respective phase. In the spin phase for example parameters such as load quantity (drum stopping time measurement), imbalance etc. can be measured and incorporated into the phase control. In this case, to ensure good water removal, the spin drying process is set to maximum water storage capacity (long duration, high system load) although many textiles can be dried out significantly more quickly. This orientation to the maximum water storage capacity also applies to the rinsing phase. Since the exchange of water for textiles with a high water retention capacity is made more difficult during rinsing, because of the assumption of a maximum water retention capacity, the rinsing and water removal is frequently more intensive than necessary.

The object of the present invention is to provide an option for more economic and longer-life operation of a washing machine which is also kinder to the textiles and saves more time. To this end both a method and also a washing machine of the generic type defined above can be specified.

To achieve this object a method and washing machine are described herein. Preferred embodiments of the invention are specified in the dependent claims. Preferred embodiments of the inventive method and preferred embodiments of the inventive washing machine, especially of their correspondingly configured, for example programmed, control device, correspond to one another, even if this is not explicitly specified in each individual case.

The invention consists of first measuring a water take-up of textiles in the wetting phase, at the start of which they are still dry. Thereafter in at least one rinsing sequence of the rinsing phase a water absorption of the textiles previously subjected to a water removal phase but still residually wet is measured. Subsequently the measurements from the two phases are compared. Since textiles with high water storage capacity (e.g. because of high retention capacity and/or tendency to swelling) produce markedly different results in water absorption behavior compared to textiles with lower water storage capacity, the water storage capacity can be determined on the basis of the comparison.

The specific water storage capacity can be included for control purposes during the following cleaning segments, especially rinsing and spinning sequences. The water storage capacity can also be used in an existing drying phase to control said phase. The frequently reduced requirements in the individual phases (duration of rinsing, spin speed etc.) allow kinder handling of textiles, especially with a low water absorption. For example textiles with a lower water absorption do not need spinning for so long in order to remove detergent residues. They also frequently do not need to be spun or dried so intensively and/or for so long. In addition water and power can be saved. The strain on the washing machine is also reduced, which increases its service life.

Basic conclusions can be drawn from the water storage capacity, specifically with measurement resolved over time, about the type of textile, e.g. about its hydrophobic or hydrophilic character, the type of the textile fiber, the textile surface pattern obtained therefrom and the processing/or the textile treatment. The individual phases can also be controlled as a function of the textile type.

It is advantageous for more simple comparison on the basis of similar framework conditions for the rinsing sequence in which the water absorption is measured to be similar to a wetting phase.

It is advantageous for the water absorption of the textiles in the rinsing phase to be measured in the rinsing sequence following the first drying sequence, because in this way the following rinsing sequences can already be adapted to the water storage capacity or the textile type.

The water absorption of the textiles is usefully measured by determining the volume of washing liquid necessary to reach a particular liquid level in the tub (level-based filling). The level can be determined with usual means such as a water level or pressure measurement through correspondingly arranged sensors. For textiles with high water absorption capacity as a rule more liquid needs to be supplied to reach the same level than for textiles with lower water absorption capacity. This measurement can also be resolved over time.

As an alternative the water absorption can be measured by measurement of the liquid level after filling with a specific volume of liquid, this too being resolved over time if necessary.

The invention also comprises a method for rinsing textiles which is based on the method for determining the water storage capacity described above, with additionally at least one rinsing sequence following on from the rinsing sequence used for measurement of the water absorption being conducted as a function of the water storage capacity or of the textile type.

In this case it is advantageous, with textiles with low water storage capacity or water retention capacity, for the framework time of the subsequent rinsing sequences to be reduced by comparison with textiles with high water retention capacity, since the lower water retention capacity permits a simpler exchange of water. This also usefully allows subsequent drying sequences to be undertaken depending on the water storage capacity, especially so that for textiles with a high water storage capacity the framework time and/or speed of the subsequent intermediate drying sequence is increased by comparison with textiles with low water storage capacity.

The invention further comprises a method for spin drying of textiles, in which the method described above for determining the water storage capacity is carried out before a spin phase for spinning the textiles, and the spin phase is also carried out as a function of the water storage capacity. For textiles with a high water storage capacity or water retention capacity in particular, the spinning framework time and/or the final spin speed can be increased by comparison with textiles with low water retention capacity in order to ensure the desired degree of drying. Specifically with such textiles it is also advantageous, at the beginning of the spin phase, for at least one pre-drying with corresponding pre-drying spin peaks to be carried out and/or a number of main spinning blocks to be provided.

Also covered by the invention is a washing machine for optional execution of the above-mentioned method, which is equipped with a suitable, especially electronic, for example programmed control unit, in which an expert system is advantageously implemented. Typical water retention parameters (resolved over time if necessary) can be stored in the expert system, for example for different types of textiles, from which the type of textile can be deduced during operation by comparison with the measured values.

BRIEF DESCRIPTION OF THE DRAWINGS

The invention is explained below with reference to an exemplary embodiment shown in the drawing. The figures show FIG. 1 a schematic diagram of a washing machine with a tub and a washing drum for holding textiles supported therein, FIG. 2 a diagram of the graph over time of a washing process as the first part of the complete drying process, FIG. 3 a diagram for the graph over time of the inventive method for rinsing the just washed textiles following on immediately from the washing process, FIG. 4 a diagram for the timing of the inventive method for spinning the just washed textiles which have a lower water absorption following on directly from the rinsing process, and FIG. 5 a diagram for the timing of the inventive method following on directly from the rinsing process for spinning the just washed textiles which have a high water absorption.

DETAILED DESCRIPTION OF EXEMPLARY EMBODIMENTS OF THE PRESENT INVENTION

Figure 1:
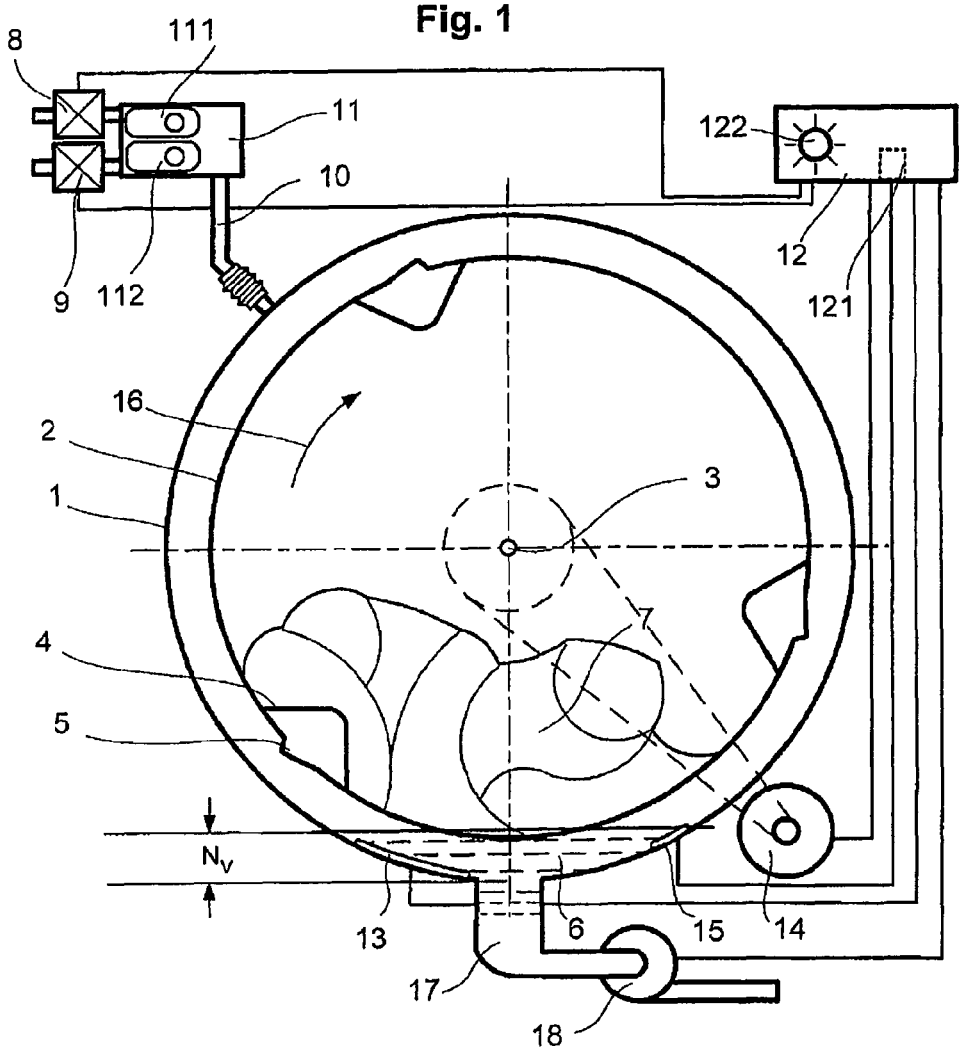

The tub 1 in FIG. 1 contains a washing drum 2 supported within it around a horizontal axis 3 with paddles 4 for the washing 7 consisting of textiles. The paddles 4 have scoops, with which liquid 6 located in the bottom of the tub 1 is scooped up during rotation of the washing 2 in the direction shown by the arrow 16 from a level Nv which lies above the lowest point of the washing drum 2 to a level above the washing 7 and can be rained down from above on the washing 7. This accelerates the wetting and flooding of the washing 7. An electric motor 14 which imparts its rotational movement to the washing drum 2 via a belt drive serves to turn the washing drum 2.

Arranged on the floor of the tub 1 is a heating device 13 which serves to heat up the washing liquid. This washing liquid 6 reaches the tub 1 by actuation of one of the magnetic valves 8 or 9 and consists either only of water or of a mixture of water and detergent. Shown in the detergent dispensing device 11 are two compartments 111 and 112 through each of which fresh water flows when the respective assigned magnetic valve is opened. Detergents which are located in the compartments are then carried by the water through the line 10 out of the detergent dispensing facility 11 into the tub 1. Liquid 6, which is located at the bottom of the tub 1 can be conveyed upwards through the drain pipe 17 and, the pump 18 in a manner not shown in any greater detail here.

All switchable and controllable devices, such as the magnetic valves 8 and 9, the heating device 13, the drum drive motor 14 and the drain pump 18, are switched or controlled by the control device 12 of the washing machine. Also used to measure the level of the liquid 6 is a water level sensor 15 which directs its measuring signals via the signaling line to an evaluation device 121 in the control device 12.

In the inventive embodiment of the washing machine the evaluation device 121 includes an expert system, in which typical water absorption parameters (resolved over time if necessary) are stored. Conclusions can be drawn about the textiles for example by comparing values measured during operation with the stored values. A comparison option consists of comparing the difference curve of the water level between wetting phase and rinsing sequence with a stored curve. In a further comparison option only individual values are compared, such as the washing liquid volume after reaching a specific level Nv. Other types of evaluation or expert system can also be used, including fuzzy logic for example.

In accordance with the invention, the washing machine shown in FIG. 1 is operated for example in the way shown in FIGS. 2 to 5. In the diagrams the scale on the ordinate is then assigned exclusively to the speed of the washing drum 2; no scale is assigned to the supplied washing liquid volume V.

Figure 2:
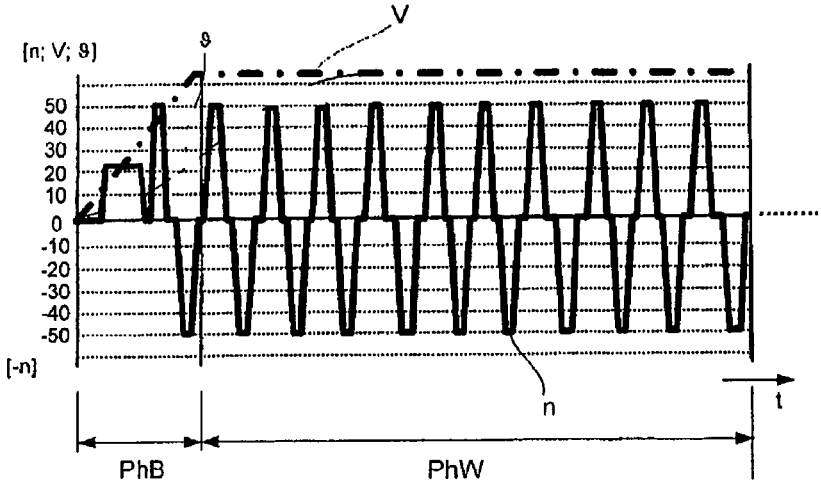

As shown in FIG. 2, for operation of the washing machine in the wetting phase PhB first the magnetic valve 8 is opened, to fill the tub 1 with water via the detergent dispenser compartment 111 filled with detergent and the line 10. The water takes the detergent with it into the tub 1, where it is distributed. Together they form the washing liquid. In this case the washing drum 2 is initially driven in accordance with the solid line n in the diagram at only a low speed (e.g. 23 rpm).

During the washing phase PhW the washing drum 2 is driven continuously reversing at for example 50 rpm, so that the washing comes intensively into contact with the washing liquid already heated up during the wetting phase PhB. At the end of the washing phase PhW the washing liquid can be optionally pumped away.

Figure 3:
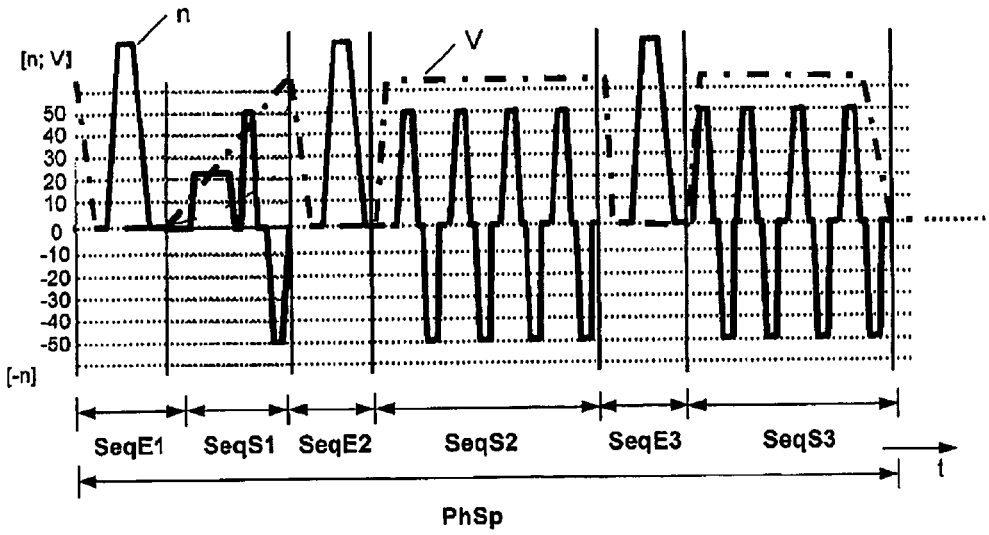

The rinsing phase PhSp shown in FIG. 3 which follows on immediately from the washing phase PhW contains alternating (intermediate) drying sequences SeqE1, SeqE2, SeqE3 and rinsing sequences SeqS1, SeqS2, SeqS3. In the drying sequences SeqE1, SeqE2, SeqE3 the washing liquid is pumped away by actuating the drain pump and the washing is spun at a low drum speed to gently dry it out, so that the residual liquid contained in the textiles is largely pushed out. During the rinsing sequences SeqS1, SeqS2, SeqS3 fresh water is introduced for further thinning of the liquid in which contamination bound to the detergent residue still remains, for example through an already emptied detergent dispensing chamber. The number of rinsing sequences SeqS1, SeqS2, SeqS3 is to be set to the desired thinning. The fresh water can optionally also be changed several times during a rinsing sequence SeqS2, SeqS3.

The first rinsing sequence SeqS 1, during which the water absorption of the textiles is measured by determination of the volume of fresh water V necessary for reaching the washing liquid level Nv, is similar to the wetting phase PhB. In this way, similar to the measurement of the water absorption capacity in the wetting phase, the water retention capacity of the same item of washing is measured for washing already wetted.

At the end of the rinsing sequence SeqS1 the water absorption measured within said sequence is compared with the water absorption specified from the wetting phase PhB, and from this the water storage capacity or the textile type is determined. In the subsequent drying sequences SeqE2, SeqE3 and/or rinsing sequences SeqS2, SeqS3 the operating parameters (speed, rinse time etc.) have been adapted to the water storage capacity or the textile type by the control unit, e.g. using an expert system.

Figure 4:
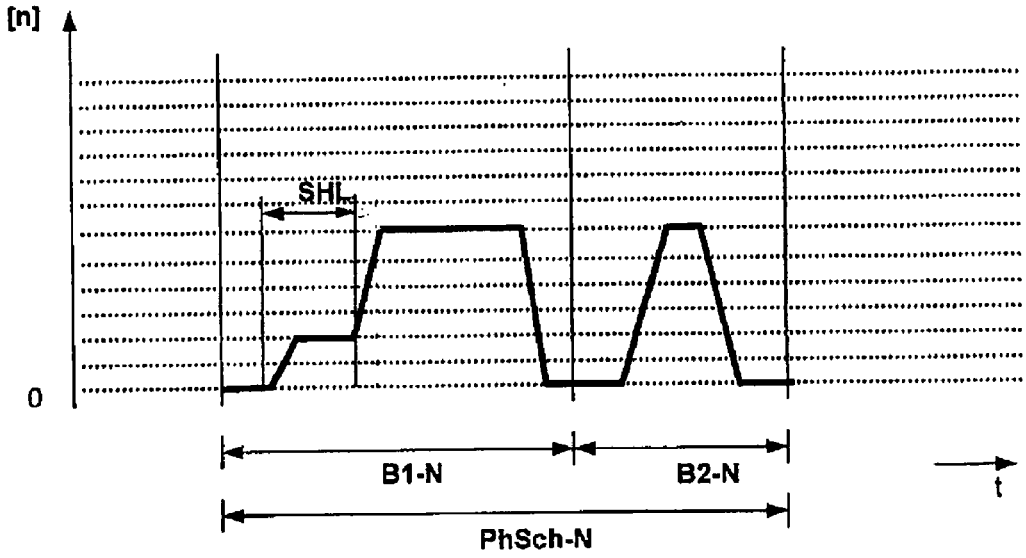
Figure 5:
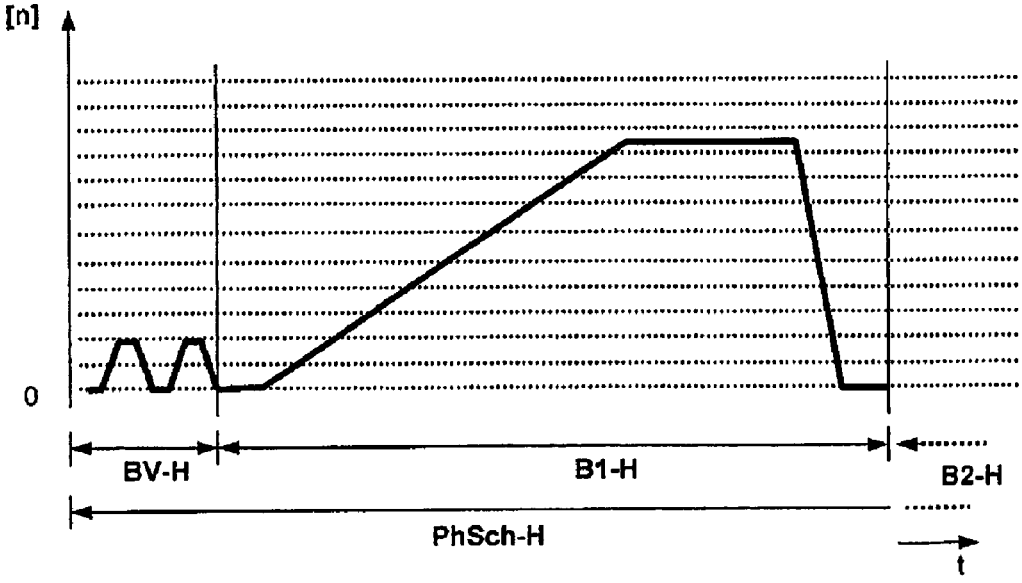

After the rinsing phase PhSp the drum drive is set to the spin mode depicted in FIG. 4 or 5. No further fresh water is supplied in this phase. The spin phase PhSch-N shown in FIG. 4 for spinning washing or textiles with low water absorption capability comprises a first main spin block B1-N, in which the spin startup in the lower area occurs slowly (wait/spin plateau SHL), since high volumes of water occur there. With the on-average slow spin startup sufficient time remains to pump out the accumulated spin water quickly enough. In the upper area (further increase in the spin speed and upper plateau) the acceleration can be correspondingly more rapid. The final spin speed and the spin framework time can be reduced by comparison with spinning of textiles with higher water absorption capability. The spin phase PhSch-N in this exemplary embodiment includes an optional further main spin block B2-N, which, because the water has already been removed, begins without a slow spin startup (SHL). The number and form of spin sequences is to be adjusted to the desired drying.

To dry textiles 7 with high water absorption capability, a spin phase PhSch-H is shown in FIG. 5 which is presented in circumstances where the variables correspond to those shown in FIG. 4. In the main spin block B1-H over the entire spin startup—for the same reason as in block B1-N in FIG. 4 and especially with high water retention capability—by comparison with B2-N there is a slow startup in the spin phase PhSch-N. The absolute spin speeds and spin framework times are still comparatively high by comparison with B1-N.

The main spin block B1-H is preceded by a preliminary drying phase BV-H which features a number of preliminary drying peaks (rinse impulses) with a comparatively low speed. The number and form of the spin sequences is to be adjusted to the desired drying, in particular a number of main spin blocks B1-H, B2-H are useful for a high water retention capability, with their number and form being dependent on the conditions actually recognized.

List of Reference Symbols

1 Tub
2 Drum
3 Horizontal axis
4 Paddle
6 Liquid
7 Washing
8 Magnetic valve
9 Magnetic valve
10 Line
11 Detergent dispensing facility
12 Control device
13 Heating device
14 Electric motor
15 Temperature sensor
16 Direction of rotation of the washing drum
17 Drain line
18 Liquid pump
111 Detergent compartment
112 Compartment
121 Evaluation device
B1-H Main spin block
B2-H Main spin block
B1-N Main spin block
B2-N Main spin block
BV-H Pre-drying phase
PhB Wetting phase
PhSch-H Spin phase
PhSch-N Spin phase
PhSp Rinsing phase
PhW Washing phase
n Speed
$N_v$ Liquid level
SeqE1 Drying sequence
SeqE2 Drying sequence
SeqE3 Drying sequence
SeqS1 Rinsing sequence
SeqS2 Rinsing sequence
SeqS3 Rinsing sequence
SHL Spin plateau
V Liquid volume

The invention claimed is:

1. A washing machine comprising: a controller for determining a water storage capacity of textiles and for controlling a wetting phase and a rinsing phase of a washing process, where the rinsing phase features a rinsing sequence following a drying sequence;

a tub;

a washing drum supported to allow it to rotate in the tub for holding the textiles;

a washing drum driver, wherein the controller is programmed to measure water absorption of the textiles during the wetting phase at a first time during the washing process, to measure water absorption of the textiles in the rinsing sequence at a second time, subsequent to the first time, in the same washing process, to compare the measured water absorption of the textiles in the wetting phase with the measured water absorption of the textiles in the rinsing sequence, and to determine water storage capacity based upon the comparison.

2. The washing machine of claim 1, wherein the controller comprises an electronic processor and controller that implements an expert system.

3. The washing machine of claim 1, wherein the controller further controls a spin drying phase for spinning the textiles depending upon the water storage capacity.

4. A method for determining a water storage capacity of textiles in a washing machine, which is equipped with devices for driving a washing drum supported rotatably in a tub as well as for controlling a wetting phase and a rinsing phase of a washing process, with the rinsing phase featuring a rinsing sequence following at least one drying sequence, the method comprising:

measuring a water absorption of the textiles in the wetting phase at a first time during the washing process;

measuring a water absorption of the textiles in the rinsing sequence at a second time, subsequent to the first time, during the same washing process;

comparing the measured water absorption of the textiles in the wetting phase with the measured water absorption of the textiles in the rinsing sequence; and determining a water storage capacity based upon the comparison.

5. The method of claim 4, wherein the measuring of a water absorption of the textiles in the rinsing sequence is similar to the measuring of a water absorption of the textiles in the wetting phase.

6. The method of claim 4, wherein the measuring of a water absorption of the textiles in the rinsing sequence comprises measuring a water absorption of the textiles in a first rinsing sequence.

7. The method of claim 4, wherein one of the measuring of a water absorption of the textiles in the wetting phase and the measuring of a water absorption of the textiles in the rinsing sequence comprises determining a level of water after supplying a specific volume of a washing liquor.

8. The method of claim 4, wherein one of the measuring of a water absorption of the textiles in the wetting phase and the measuring of a water absorption of the textiles in the rinsing sequence comprises determining a volume of washing liquor necessary for reaching a specific level.

9. The method of claim 4, further comprising setting a following rinsing sequence based upon the determined water storage capacity.

10. The method of claim 9, wherein the following rinsing sequence is carried out so that for textiles with high water retention capacity the framework time is increased by comparison with textiles with low water retention capacity.

11. The method of claim 10, further comprising executing a following drying sequence based upon the determined water storage capacity.

12. The method of claim 11, wherein the time and/or speed of a washing drum is higher for textiles having a high water storage capacity than for textiles having a lower water storage capacity during the following drying sequence.

13. The method of claim 4, further comprising spin drying the textiles based upon the determined water storage capacity.

14. The method as claimed in claim 13, wherein the time for spin drying the textiles is higher for textiles with a high water storage capacity than for textiles with a lower water storage capacity.

15. The method of claim 14, wherein a final spin speed of the spin drying is higher for textiles with a high water storage capacity than for textiles with a lower water storage capacity.

16. The method of claim 13, wherein the spin drying comprises a preliminary drying operation at a beginning of the spin drying.

17. The method of claim 13, wherein the spin drying comprises providing a main spin block.

* * * * *